US011187428B2

(12) United States Patent
Sakaguchi

(10) Patent No.: US 11,187,428 B2
(45) Date of Patent: Nov. 30, 2021

(54) AIR CONDITIONING DEVICE REMOTE CONTROL APPARATUS AND AIR CONDITIONING SYSTEM

(71) Applicant: Mitsubishi Electric Corporation, Tokyo (JP)

(72) Inventor: Hiroaki Sakaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 101 days.

(21) Appl. No.: 16/493,903

(22) PCT Filed: Apr. 6, 2017

(86) PCT No.: PCT/JP2017/014382
§ 371 (c)(1),
(2) Date: Sep. 13, 2019

(87) PCT Pub. No.: WO2018/185913
PCT Pub. Date: Oct. 11, 2018

(65) Prior Publication Data

US 2020/0025404 A1 Jan. 23, 2020

(51) Int. Cl.
*F24F 11/57* (2018.01)
*G08C 17/02* (2006.01)
(Continued)

(52) U.S. Cl.
CPC ..... *F24F 11/57* (2018.01); *F24F 11/58* (2018.01); *F24F 11/63* (2018.01); *G08C 17/02* (2013.01); *G08C 2201/93* (2013.01)

(58) Field of Classification Search
CPC .. F24F 11/54; F24F 11/56; F24F 11/57; F24F 11/58; F24F 11/63; F24F 11/89;
(Continued)

(56) References Cited

U.S. PATENT DOCUMENTS

2010/0081392 A1* 4/2010 Rousseau ..... G08C 17/02 455/67.14
2010/0201891 A1* 8/2010 Laroia ..... G08C 17/00 348/734

(Continued)

FOREIGN PATENT DOCUMENTS

JP 2015-064154 A 4/2015
JP 2015-224858 A 12/2015

OTHER PUBLICATIONS

European Extended Search Report dated Feb. 6, 2020 in the corresponding EP application No. 17904778.2.

*Primary Examiner* — Yong Hang Jiang
(74) *Attorney, Agent, or Firm* — Posz Law Group, PLC

(57) ABSTRACT

An air conditioning device remote control apparatus is provided with a transmission unit that transmits an operation signal to an associated air conditioning device, a wireless communication unit that performs wireless communication with an external wireless communication device or another remote control apparatus, and a main control unit that controls the transmission unit and the wireless communication unit. In a case in which the wireless communication unit receives an operation signal from the external wireless communication device or the another remote control apparatus, the main control unit transmits the operation signal to the associated air conditioning device, and performs detection of another remote control apparatus emitting radio waves. In a case in which the wireless communication unit detects another remote control apparatus emitting radio waves, the main control unit transmits, via the wireless communication unit, the operation signal to the another remote control apparatus emitting radio waves.

17 Claims, 10 Drawing Sheets

(51) Int. Cl.
*F24F 11/58* (2018.01)
*F24F 11/63* (2018.01)

(58) Field of Classification Search
CPC .... G08C 17/00; G08C 17/02; G08C 2201/40; G08C 2201/93
See application file for complete search history.

(56) References Cited

U.S. PATENT DOCUMENTS

| | | | | |
|---|---|---|---|---|
| 2012/0253521 | A1* | 10/2012 | Storm | G05B 15/02 700/276 |
| 2013/0290551 | A1* | 10/2013 | Yang | H04L 65/1013 709/228 |
| 2014/0163751 | A1* | 6/2014 | Davis | G05B 15/02 700/286 |
| 2016/0209059 | A1 | 7/2016 | Castillo et al. | |
| 2017/0041524 | A1* | 2/2017 | Schoenen | H04B 10/1149 |
| 2017/0195896 | A1* | 7/2017 | Lee | H04L 41/0893 |

* cited by examiner

AIR CONDITIONING DEVICE REMOTE CONTROL APPARATUS AND AIR CONDITIONING SYSTEM

CROSS REFERENCE TO RELATED APPLICATION

This application is a U.S. national stage application of PCT/JP2017/014382 filed on Apr. 6, 2017, the contents of which are incorporated herein by reference.

TECHNICAL FIELD

The present invention relates to an air conditioning device remote control apparatus and an air conditioning system accepting operation from an external wireless communication device.

BACKGROUND ART

In the related art, a remote control apparatus that controls an air conditioning device has been proposed in which operation from an external wireless device such as a smartphone or a tablet is possible (for example, see Patent Literature 1).

The remote control apparatus described in Patent Literature 1 is provided with an operation unit that sets a setting allowing the air conditioning device to be operated by an external wireless communication device, transmission means that transmits the allowed setting to the external wireless communication device, and a reception unit that receives an operation signal for the air conditioning device transmitted from the external wireless communication device. Subsequently, by transmitting a transmission signal received from the external wireless communication device to the air conditioning device, it is possible to operate the air conditioning device from the external wireless communication device.

CITATION LIST

Patent Literature

Patent Literature 1: Japanese Unexamined Patent Application Publication No. 2015-224858

SUMMARY OF INVENTION

Technical Problem

In environments where multiple air conditioning devices are installed inside a building, such as an office building or a hotel, multiple remote control apparatuses associated with each of the air conditioning devices may also be installed. In such environments, in the case of wanting to change a setting in multiple air conditioning devices from an external wireless communication device, in the past it has been necessary to transmit an operation signal from the external wireless communication device to each remote control apparatus. In other words, because it is necessary for a user to perform a similar operation on the external wireless communication device repeatedly for each of the multiple air conditioning devices for which the user wants to change the setting, there is a problem in that changing the setting is extremely burdensome and time-consuming.

The present invention has been devised to overcome problems like the above, and an object thereof is to provide an air conditioning device remote control apparatus and an air conditioning system that make it possible to change a setting in multiple air conditioning devices from an external wireless communication device with a single operation.

Solution to Problem

An air conditioning device remote control apparatus according to an embodiment of the present invention is provided with a transmission unit that transmits an operation signal to an associated air conditioning device; a wireless communication unit that performs wireless communication with an external wireless communication device or another remote control apparatus; and a main control unit that controls the transmission unit and the wireless communication unit, wherein in a case in which the wireless communication unit receives an operation signal from the external wireless communication device or the another remote control apparatus, the main control unit transmits, via the transmission unit, the operation signal to the associated air conditioning device, and performs, via the wireless communication unit, detection of another remote control apparatus emitting radio waves, and in a case in which the wireless communication unit detects the another remote control apparatus emitting radio waves, the main control unit transmits, via the wireless communication unit, the operation signal to the another remote control apparatus emitting radio waves.

Advantageous Effects of Invention

According to the air conditioning device remote control apparatus according to an embodiment of the present invention, in the case in which an operation signal is received from an external wireless communication device or another remote control apparatus, detection of another remote control apparatus emitting radio waves is performed, and in the case of detecting another remote control apparatus emitting radio waves, the operation signal is transmitted to the another remote control apparatus emitting the radio waves. Therefore, it becomes possible to change a setting in multiple air conditioning devices from the external wireless communication device with a single operation.

DESCRIPTION OF EMBODIMENTS

Figure 1:
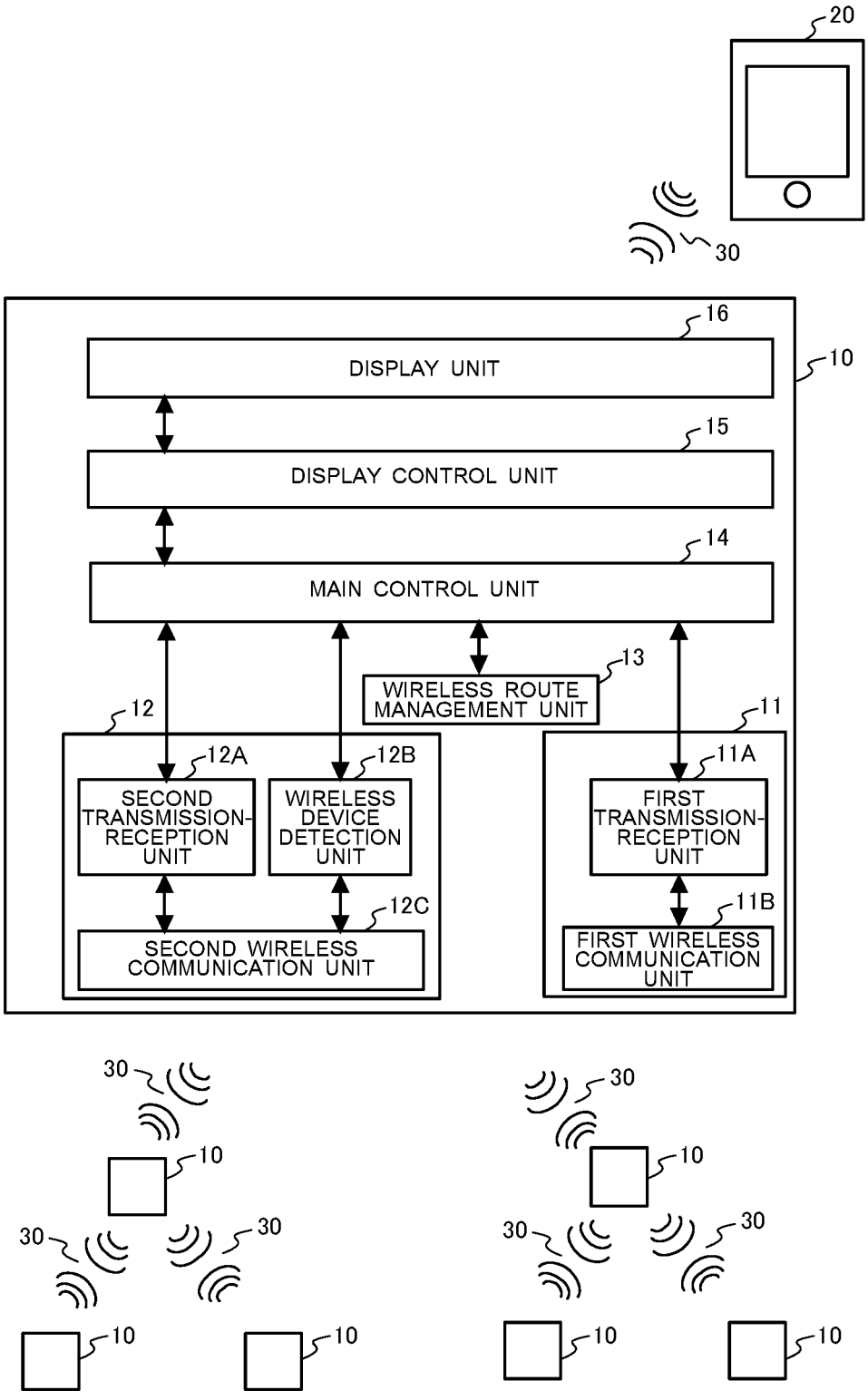
FIG. 1 is a diagram illustrating an overall configuration and function blocks of an air conditioning device remote control apparatus according to Embodiment 1 of the present invention.

Hereinafter, embodiments of the present invention will be described on the basis of the drawings. Note that the present invention is not limited by the embodiments described hereinafter. Also, in the drawings hereinafter, the relative sizes of respective structural members may differ from actual sizes in some cases.

Embodiment 1

FIG. 1 is a diagram illustrating an overall configuration and function blocks of an air conditioning device remote control apparatus 10 according to Embodiment 1 of the present invention.

Hereinafter, FIG. 1 will be referenced to describe the remote control apparatus 10 plurally installed in correspondence with each air conditioning device in an environment in which multiple air conditioning devices are installed inside a building, such as an office building or a hotel.

The remote control apparatus 10 according to Embodiment 1 is capable of performing wireless communication with not only the associated air conditioning device but also an external wireless communication device 20, such as a smartphone or a tablet, and in addition, is also capable of performing wireless communication with other remote control apparatus 10.

In the remote control apparatus 10, there is set an allow setting that allows changing the operation of the air conditioning device associated with itself from another remote control apparatus 10, or a deny setting that denies changing the operation of the air conditioning device associated with itself. Note that in Embodiment 1, it is assumed that the allow setting is set in all of the remote control apparatus 10.

The remote control apparatus 10 is provided with a first communication control unit 11, a second communication control unit 12, a wireless route management unit 13, a main control unit 14, a display control unit 15, a display unit 16, and an operation unit (not illustrated). Also, the first communication control unit 11 is provided with a first transmission-reception unit 11A and a first wireless communication unit 11B, while the second communication control unit 12 is provided with a second transmission-reception unit 12A, a wireless device detection unit 12B, and a second wireless communication unit 12C.

The first communication control unit 11 performs wireless communication with the associated air conditioning device by infrared for example. The first transmission-reception unit 11A transmits signals such as operation signal to the associated air conditioning device through the first wireless communication unit 11B, and also receives a signal related to information such as operating information from the associated air conditioning device through the first wireless communication unit 11B.

Note that in Embodiment 1, the first communication control unit 11 is configured to perform wireless communication with the associated air conditioning device, but is not limited thereto, and may also be configured to perform wired communication. Also, the first transmission-reception unit 11A is configured to receive a signal related to information such as operating information from the associated air conditioning device, but is not limited thereto, and it is sufficient for the first transmission-reception unit 11A to be able to at least transmit an operation signal to the associated air conditioning device.

The second communication control unit 12 performs wireless communication with the external wireless communication device 20 or another remote control apparatus 10 by technology such as Bluetooth (registered trademark), for example. The second transmission-reception unit 12A transmits signals such as an operation signal to another remote control apparatus 10 through the second wireless communication unit 12C.

Also, the second transmission-reception unit 12A receives an operation signal from the external wireless communication device 20 or another remote control apparatus 10 through the second wireless communication unit 12C, and receives wireless route information 100 from another remote control apparatus 10 through the second wireless communication unit 12C.

Figure 2:
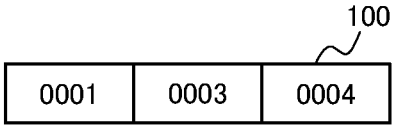
FIG. 2 is wireless route information according to Embodiment 1 of the present invention.

FIG. 2 is the wireless route information 100 according to Embodiment 1 of the present invention.

Herein, as illustrated in FIG. 2, the wireless route information 100 refers to information including an ID that identifies the remote control apparatus 10. Also, the wireless route information 100 includes information related to the ID of each remote control apparatus 10 that has received a setting change operation signal. The wireless route information 100 includes the order of the remote control apparatus 10 that have received the setting change operation signal.

For example, as illustrated in FIG. 2, the wireless route information 100 includes ID:0001 of the remote control apparatus 10 that received the setting change operation signal first, ID:0003 of the remote control apparatus 10 that received the setting change operation signal from the remote control apparatus 10 with ID:0001, and ID:0004 of the remote control apparatus 10 that received the setting change operation signal from the remote control apparatus 10 with ID:0003, and these IDs are joined in order.

The wireless device detection unit 12B uses the second wireless communication unit 12C to detect other remote control apparatus 10. Note that the remote control apparatus 10 emit radio waves, and the wireless device detection unit 12B detects other remote control apparatus 10 by having the second wireless communication unit 12C detect the radio waves.

Note that the first communication control unit 11 corresponds to the "transmission unit" of the present invention, and the second communication control unit 12 corresponds to the "wireless communication unit" of the present invention.

The wireless route management unit 13 saves information such as the IDs of other detected remote control apparatus 10, the radio wave strengths of the another detected remote control apparatus 10, and information regarding its own allow setting/deny setting.

Herein, each remote control apparatus 10 has an ID unique to every single apparatus, and each remote control apparatus 10 is specifiable from the ID.

The display control unit 15 controls the display unit 16. The display unit 16 includes a liquid crystal panel, for example, and displays various information. Also, the operation unit (not illustrated) includes buttons, for example, and accepts an operation related to a setting change in the associated air conditioning device performed by the user.

The main control unit 14 controls the first communication control unit 11, the second communication control unit 12, the wireless route management unit 13, and the display control unit 15. Note that the main control unit 14 may be configured by hardware such as a circuit device that realizes the functions of the main control unit 14, and may also be configured by a computational device such as a CPU or a microprocessor and software that stipulates the operations of the computational device.

The remote control apparatus 10 according to Embodiment 1 is provided with a "normal mode" that, in the case in which an operation signal of an air conditioning device setting change is received from the external wireless communication device 20, performs the setting change only in the associated air conditioning device, and a "batch setting mode" that, while performing the setting change in the associated air conditioning device, also transmits an operation signal to other remote control apparatus 10 emitting radio waves of a strength equal to or greater than a reference value, and performs the setting change in each air conditioning device associated with the transmission destination remote control apparatus 10.

Figure 3:
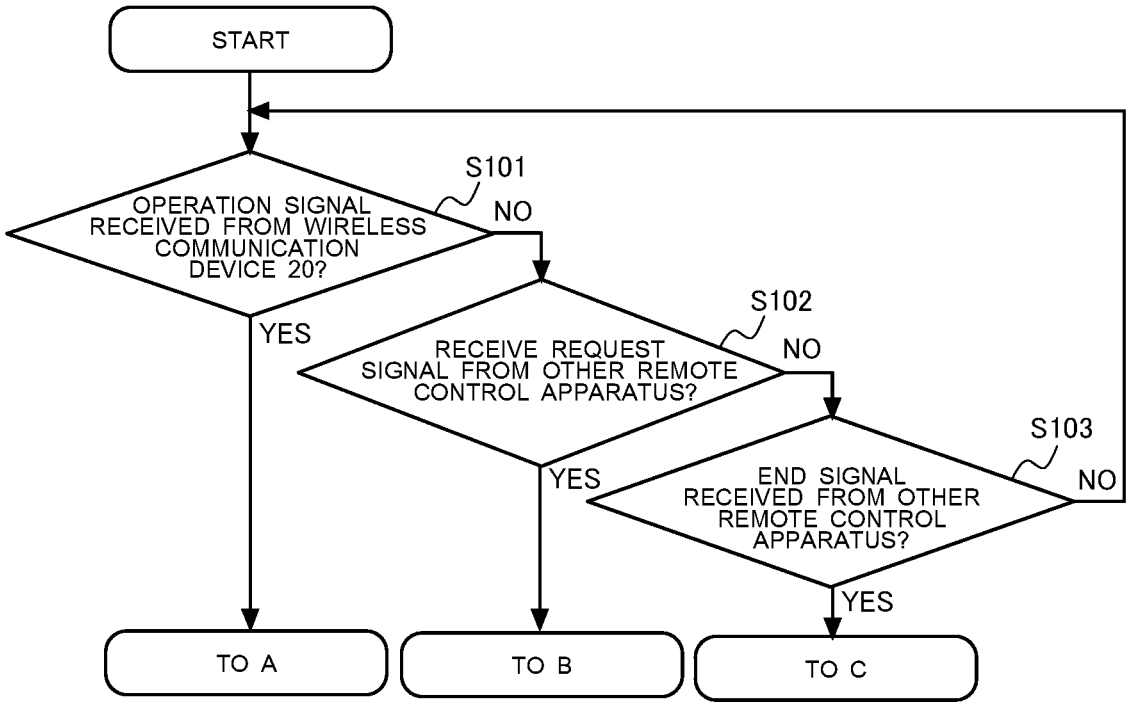
FIG. 3 is a diagram illustrating a first control flow of a slave remote control apparatus of an air conditioning device according to Embodiment 1 of the present invention.
Figure 4:
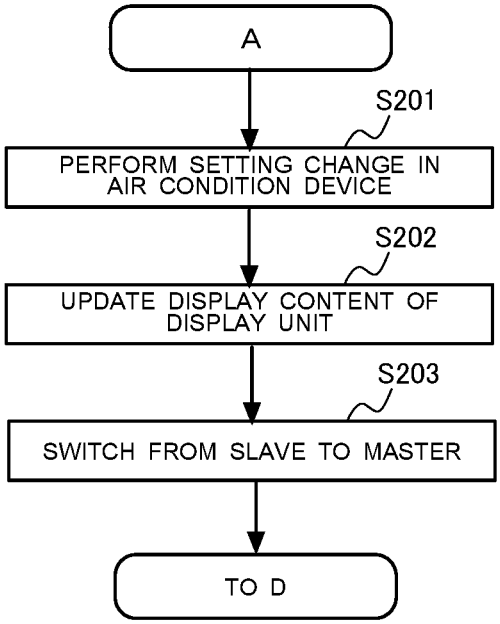
FIG. 4 is a diagram illustrating a second control flow of a slave remote control apparatus of an air conditioning device according to Embodiment 1 of the present invention.
Figure 5:
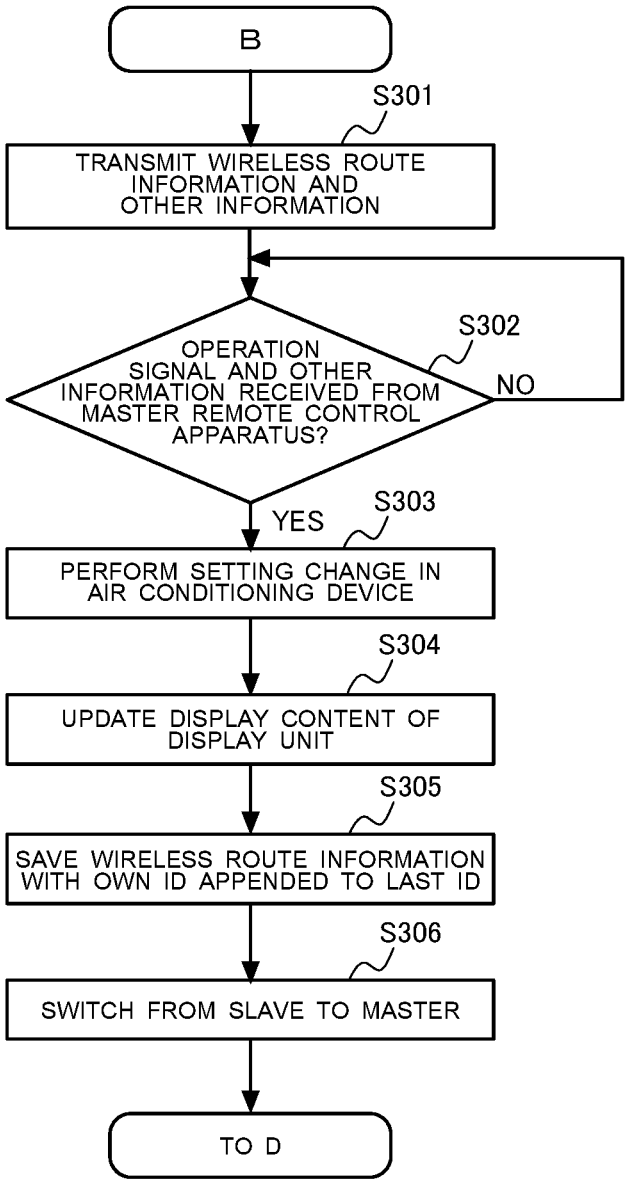
FIG. 5 is a diagram illustrating a third control flow of a slave remote control apparatus of an air conditioning device according to Embodiment 1 of the present invention.
Figure 6:
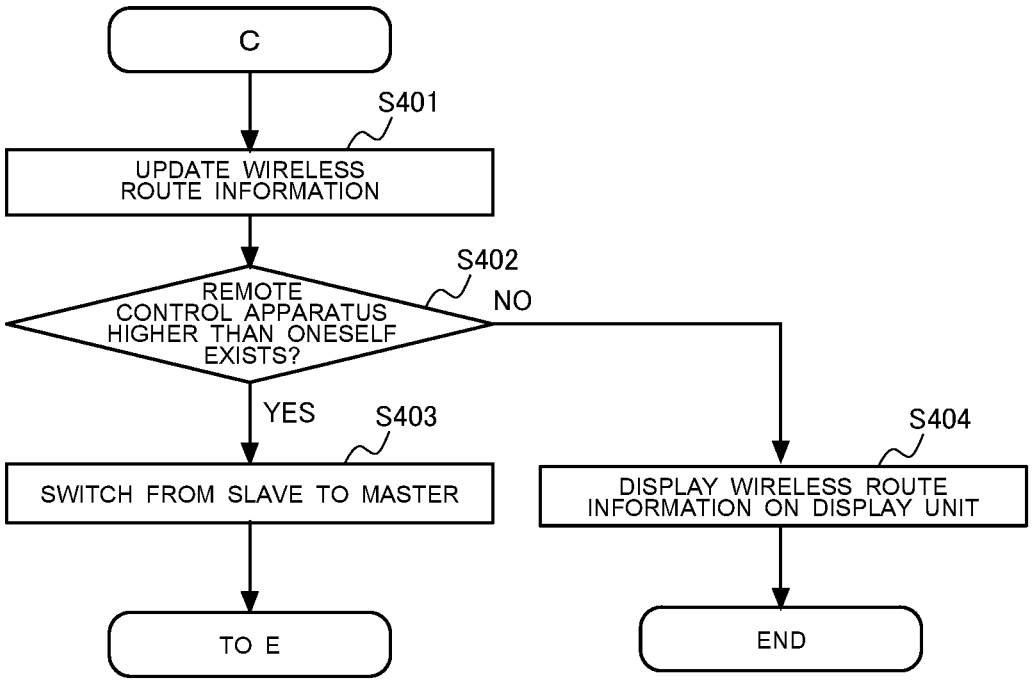
FIG. 6 is a diagram illustrating a fourth control flow of a slave remote control apparatus of an air conditioning device according to Embodiment 1 of the present invention.
Figure 7:
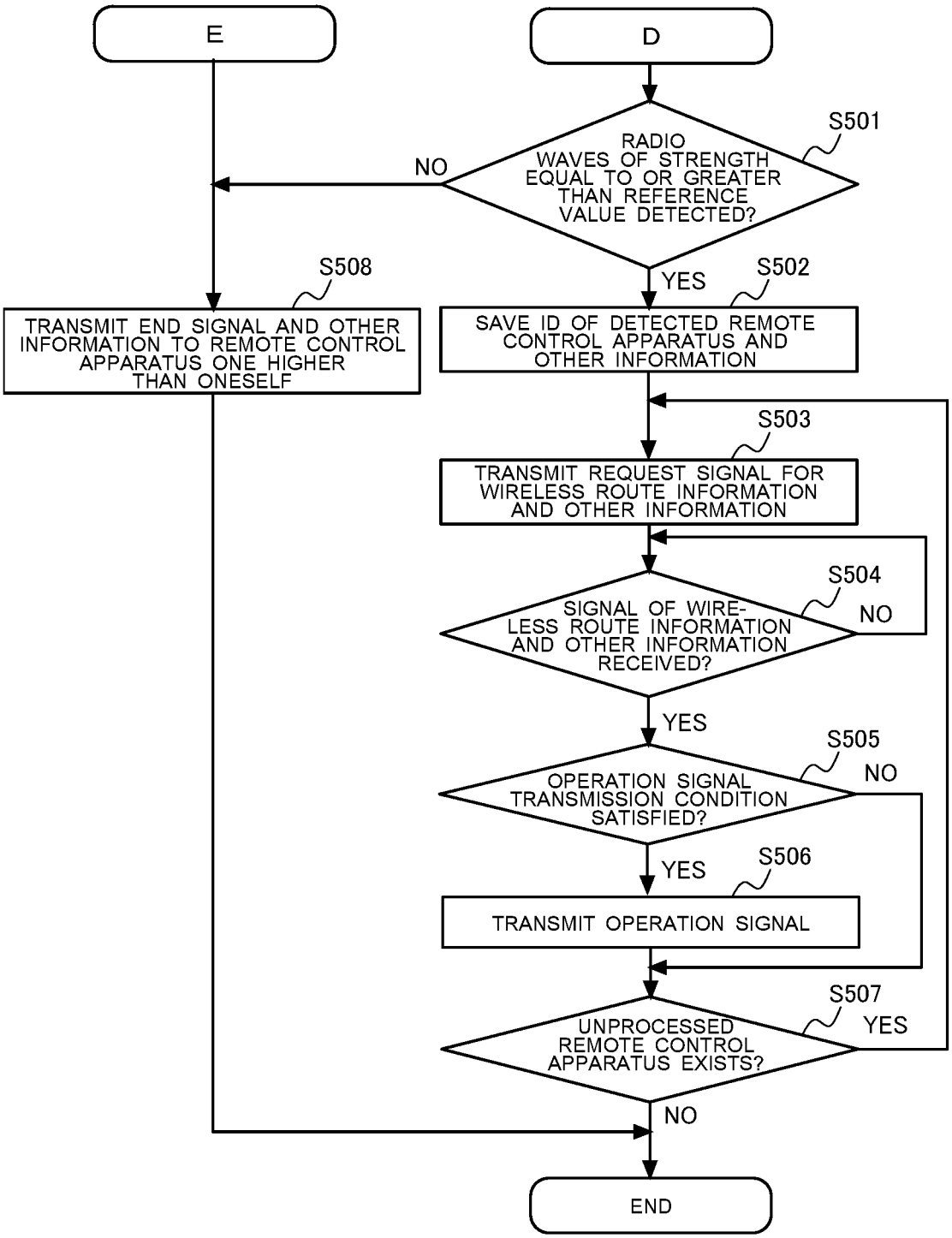
FIG. 7 is a diagram illustrating a control flow of a master remote control apparatus of an air conditioning device according to Embodiment 1 of the present invention.

FIG. 3 is a diagram illustrating a first control flow of a slave remote control apparatus 10 of an air conditioning device according to Embodiment 1 of the present invention, FIG. 4 is a diagram illustrating a second control flow of a slave remote control apparatus 10 of an air conditioning device according to Embodiment 1 of the present invention, FIG. 5 is a diagram illustrating a third control flow of a slave remote control apparatus 10 of an air conditioning device according to Embodiment 1 of the present invention, FIG. 6 is a diagram illustrating a fourth control flow of a slave remote control apparatus 10 of an air conditioning device according to Embodiment 1 of the present invention, and FIG. 7 is a diagram illustrating a control flow of a master remote control apparatus 10 of an air conditioning device according to Embodiment 1 of the present invention.

Hereinafter, FIGS. 3 to 7 will be used to describe control flows of the air conditioning device remote control apparatus 10 when changing the settings of air conditioning devices from the external wireless communication device 20 in the "batch setting mode".

From a display unit (not illustrated) of the external wireless communication device 20 for example, the user performs an operation related to a setting change, and selects a desired air conditioning device on which to perform the setting change. Subsequently, the external wireless communication device 20 transmits an operation signal of an air conditioning device setting change to the remote control apparatus 10 associated with the selected air conditioning device.

The main control unit 14 of the selected remote control apparatus 10 determines, on the basis of a notification from the second communication control unit 12, whether or not the operation signal of an air conditioning device setting change has been received from the external wireless communication device 20 (step S101).

In the case of determining that the operation signal of an air conditioning device setting change has been received from the external wireless communication device 20 (YES in step S101), the main control unit 14 instructs the first communication control unit 11 to transmit a setting change operation signal to the associated air conditioning device, and also notifies the display control unit 15 of the content of the setting change in the associated air conditioning device.

The second communication control unit 12, according to an instruction from the main control unit 14, transmits the setting change operation signal to the associated air conditioning device, and performs the setting change in the associated air conditioning device (step S201). Also, after receiving the notification from the main control unit 14, the display control unit 15 updates the display content of the display unit 16 to make the display unit 16 reflect the content of the setting change in the associated air conditioning device (step S202).

After step S202, the above selected remote control apparatus 10 switches from serving as slave to serving as master (step S203). In other words, the above selected remote control apparatus 10 switches from being the receiver to being the transmitter of the operation signal of an air conditioning device setting change.

After step S203, the second communication control unit 12, according to an instruction from the main control unit 14, detects radio waves being emitted from other remote control apparatus 10. Subsequently, on the basis of a notification from the second communication control unit 12, the main control unit 14 determines whether or not a remote control apparatus 10 emitting radio waves of a strength equal to or greater than the reference value exists (step S501).

In the case of determining that a remote control apparatus 10 emitting radio waves of a strength equal to or greater than the reference value exists (YES in step S501), the main control unit 14 proceeds to step S502. On the other hand, in the case of determining that a remote control apparatus 10 emitting radio waves of a strength equal to or greater than the reference value does not exist (NO in step S501), the main control unit 14 proceeds to step S508. Note that the process in step S508 will be described later.

In step S502, the main control unit 14 saves, via the wireless route management unit 13, the ID of the detected remote control apparatus 10 and the radio wave strength of the detected remote control apparatus 10 (step S502).

Also, the second communication control unit 12, according to an instruction from the main control unit 14, transmits a request signal for automatic change information and the wireless route information 100 to the remote control apparatus 10 emitting radio waves of a strength equal to or greater than the reference value (step S503). Note that the automatic change information includes information related to the allow setting/deny setting.

At this point, in the case in which the main control unit 14 detects, via the second communication control unit 12, multiple remote control apparatuses 10 emitting radio waves of a strength equal to or greater than the reference value, the main control unit 14 instructs the second communication control unit 12 to transmit the request signal for the automatic change information and the wireless route information 100 sequentially, starting from the remote control apparatus 10 emitting the strongest radio waves among those detected.

In the case in which the second communication control unit 12 of the slave remote control apparatus 10 emitting radio waves of a strength equal to or greater than the reference value receives the request signal for the automatic change information and the wireless route information 100

(YES in step S102), the second communication control unit 12 notifies the main control unit 14 and, according to an instruction from the main control unit 14, transmits the automatic change information and the wireless route information 100 to the transmission source, namely the master remote control apparatus 10 (step S301).

In the case in which the second communication control unit 12 of the master remote control apparatus 10 receives the automatic change information and the wireless route information 100 from the slave remote control apparatus 10 (YES in step S504), the second communication control unit 12 notifies the main control unit 14, and from the received information, the main control unit 14 determines whether or not an operation signal transmission condition is satisfied (step S505).

At this point, the operation signal transmission condition is that the allow setting is set in the remote control apparatus 10 of the transmission destination, and that the ID of the remote control apparatus 10 of the transmission destination is not included in the wireless route information 100.

Note that the case in which the ID of the remote control apparatus 10 of the transmission destination is included in the received wireless route information 100 means that the remote control apparatus 10 of the transmission destination has already received the operation signal of an air conditioning device setting change from another remote control apparatus 10. Accordingly, in this case, by not transmitting the operation signal of an air conditioning device setting change and the wireless route information 100 to the remote control apparatus 10 of the transmission destination, duplication of the setting change in the air conditioning device can be avoided.

In step S505, in the case in which the main control unit 14 of the master remote control apparatus 10 determines that the operation signal transmission condition is satisfied (YES in step S505), the second communication control unit 12, according to an instruction from the main control unit 14, transmits the operation signal of an air conditioning device setting change and the wireless route information 100 to the slave remote control apparatus 10 (step S506), and proceeds to step S507. On the other hand, in the case of determining that the operation signal transmission condition is not satisfied (NO in step S505), the main control unit 14 does not execute step S506 and proceeds to step S507.

In step S507, the main control unit 14 of the master remote control apparatus 10 determines whether or not an unprocessed remote control apparatus 10 exists among the detected remote control apparatus 10. In the case of determining that an unprocessed remote control apparatus 10 exists (YES in step S507), the main control unit 14 returns to step S503 and repeats the process of steps S503 to S507. On the other hand, in the case of determining that an unprocessed remote control apparatus 10 does not exist, the main control unit 14 ends the process.

Also, after step S301, on the basis of a notification from the second communication control unit 12, the main control unit 14 of the slave remote control apparatus 10 determines whether or not the operation signal of an air conditioning device setting change and the wireless route information 100 has been received from the master remote control apparatus 10 (step S302).

In the case of determining that the operation signal of an air conditioning device setting change and the wireless route information 100 has been received from the master remote control apparatus 10 (YES in step S302), the main control unit 14 instructs the first communication control unit 11 to transmit a setting change operation signal to the associated air conditioning device, and also notifies the display control unit 15 of the content of the setting change in the associated air conditioning device.

The second communication control unit 12, according to an instruction from the main control unit 14, transmits the setting change operation signal to the associated air conditioning device, and performs the setting change in the associated air conditioning device (step S303). Also, after receiving the notification from the main control unit 14, the display control unit 15 updates the display content of the display unit 16 to make the display unit 16 reflect the content of the setting change in the associated air conditioning device (step S304).

In addition, the main control unit 14 saves, via the wireless route management unit 13, the received wireless route information 100. At this time, the main control unit 14 saves its own ID appended to the last ID among the IDs of remote control apparatus 10 included in the received wireless route information 100 (step S305).

For example, in the case of receiving the wireless route information 100 illustrated in FIG. 2, since the last ID is 0003 and one's own ID is 0004, the main control unit 14 saves ID:0004 appended to ID:0003.

After step S305, the slave remote control apparatus 10 switches from serving as slave to serving as master (step S306). In other words, the above selected remote control apparatus 10 switches from being the receiver to being the transmitter of signals such as the operation signal of an air conditioning device setting change.

After step S306, the second communication control unit 12, according to an instruction from the main control unit 14, detects radio waves being emitted from other remote control apparatus 10. Subsequently, on the basis of a notification from the second communication control unit 12, the main control unit 14 determines whether or not a remote control apparatus 10 emitting radio waves of a strength equal to or greater than the reference value exists (step S501).

In the case of determining that a remote control apparatus 10 emitting radio waves of a strength equal to or greater than the reference value exists (YES in step S501), the main control unit 14 proceeds to step S502. Note that since the process from step S502 to step S507 is similar to the above, a description is omitted.

On the other hand, in the case in which the main control unit 14 determines that a remote control apparatus 10 emitting radio waves of a strength equal to or greater than the reference value does not exist (NO in step S501), the main control unit 14 references, via the wireless route management unit 13, the saved wireless route information 100.

Additionally, the second communication control unit 12, according to an instruction from the main control unit 14, transmits an end signal and the wireless route information 100 to the remote control apparatus 10 with the ID higher in rank than its own ID by one ID in the array of IDs of the wireless route information (step S508).

For example, in the case of referencing the wireless route information 100 illustrated in FIG. 2, since one's own ID is 0004 and the ID that is higher in rank than itself by one ID in the array of IDs of the wireless route information is 0003, the second communication control unit 12 transmits the end signal and the wireless route information 100 to the remote control apparatus 10 with ID:0003.

At this point, the wireless route information 100 transmitted together with the end signal includes a list of IDs of the remote control apparatus 10 associated with the air conditioning devices whose settings have been changed, and includes the IDs of the remote control apparatus 10 associated with the air conditioning devices whose settings have been changed starting from the ID of the selected remote control apparatus 10 and proceeding in the order in which the setting change operation signal was received.

In the case in which the second communication control unit 12 of the remote control apparatus 10 higher in rank than the transmission source remote control apparatus 10 by one ID in the array of IDs of the wireless route information has received the end signal and the wireless route information 100 (YES in step S103), the second communication control unit 12 notifies the main control unit 14, and the main control unit 14 saves, via the wireless route management unit 13, the wireless route information 100 received from the remote control apparatus 10 with the ID lower in rank than its own ID by one ID in the array of IDs of the wireless route information (step S401). At this time, the main control unit 14 causes information related to the radio wave strength of other remote control apparatus 10 detected by itself saved in the wireless route management unit 13 to be included in the wireless route information 100 to save. Note that the wireless route information 100 to save includes all of the IDs of the remote control apparatus 10 that received the setting change operation signal on a single route.

After step S401, the main control unit 14 references, via the wireless route management unit 13, the saved wireless route information 100, and determines whether or not a remote control apparatus 10 with an ID higher in rank than its own ID by one ID in the array of IDs of the wireless route information exists (step S402).

In the case in which the main control unit 14 determines that a remote control apparatus 10 with an ID higher in rank than its own ID by one ID in the array of IDs of the wireless route information exists (YES in step S402), the remote control apparatus 10 switches from serving as slave to serving as master (step S403). In other words, the remote control apparatus 10 switches from being the receiver to the transmitter of signals such as the end signal.

After step S403, the second communication control unit 12, according to an instruction from the main control unit 14, transmits the end signal and the wireless route information 100 to the remote control apparatus 10 with the ID higher in rank than its own ID by one ID in the array of IDs of the wireless route information (step S508).

On the other hand, in the case of determining that a remote control apparatus 10 with an ID higher in rank than its own ID by one ID in the array of IDs of the wireless route information does not exist (NO in step S402), the main control unit 14 notifies the display control unit 15 that the wireless route information 100 has been received from the remote control apparatus 10 with the ID lower in rank than its own ID by one ID in the array of IDs of the wireless route information.

After receiving the notification from the main control unit 14, the display control unit 15 displays the wireless route information 100 received from the remote control apparatus 10 with the ID lower in rank than its own ID by one ID in the array of IDs of the wireless route information on the display unit 16 (step S404).

Note that step S404 is not limited to the above, and after receiving the notification from the main control unit 14, the display control unit 15 may also display an indication that the wireless route information 100 received from the remote control apparatus 10 with the ID lower in rank than its own ID by one ID in the array of IDs of the wireless route information is displayable on the display unit 16, and display the wireless route information 100 on the display unit 16 according to a request from the user.

With this arrangement, all air conditioning devices whose settings have been changed on a single route are displayed on the display unit 16. Additionally, by performing this process on all routes, all air conditioning devices whose settings have been changed on all routes are displayed on the display unit 16. For this reason, the user is able to know all of the air conditioning devices whose settings have been changed from the selected remote control apparatus 10.

Also, because the remote control apparatus 10 selected by the user is capable of obtaining information related to all routes and the radio wave strength of the air conditioning devices whose settings have been changed, it is possible to form an optimal route and change settings in air conditioning devices on the basis of the optimal route from the next time onward. At this point, the optimal route refers to a route having the fastest speed of changing settings in the air conditioning devices, and in the case in which multiple transmission routes exist for the remote control apparatus 10 with an ID lower in rank than its own ID by one ID in the array of IDs of the wireless route information, the optimal route is formed by selecting the transmission route with the highest radio wave strength. Since radio wave strength is proportional to the transmission speed, by forming the optimal route, it is possible to transmit the operation signal in the shortest time to the air conditioning devices lower than oneself.

As above, the air conditioning device remote control apparatus 10 according to Embodiment 1 is provided with the first communication control unit 11 that transmits the operation signal to the associated air conditioning device, the second communication control unit 12 that performs wireless communication with the external wireless communication device 20 or another remote control apparatus 10, and the main control unit 14 that controls the first communication control unit 11 and the second communication control unit 12. In the case in which the second communication control unit 12 receives the operation signal from the external wireless communication device 20 or another remote control apparatus 10, the main control unit 14 transmits, via the first communication control unit 11, the operation signal to the associated air conditioning device, and detects, via the second communication control unit 12, other remote control apparatus 10 emitting radio waves. In the case in which the second communication control unit 12 detects another remote control apparatus 10 emitting radio waves, the main control unit 14 transmits, via the second communication control unit 12, the operation signal to the another remote control apparatus 10 emitting radio waves.

According to the air conditioning device remote control apparatus 10 according to Embodiment 1, in the case in which the operation signal is received from the external wireless communication device 20 or another remote control apparatus 10, detection of another remote control apparatus 10 emitting radio waves is performed, and in the case of detecting another remote control apparatus 10 emitting radio waves, the operation signal is transmitted to the another remote control apparatus 10 emitting the radio waves. Therefore, it becomes possible to change a setting in multiple air conditioning devices from the external wireless communication device 20 with a single operation.

Also, the air conditioning device remote control apparatus 10 according to Embodiment 1 is provided with the wireless route management unit 13 that saves the wireless route information 100 including IDs that identify the remote control apparatus 10. The wireless route information 100 includes the IDs of the remote control apparatus 10 that have received the operation signal thus far, in the order that the operation signal was received. In the case in which the second communication control unit 12 receives the wireless route information 100 from another remote control apparatus 10, the main control unit 14 saves, via the wireless route management unit 13, its own ID appended to the last ID among the IDs included in the wireless route information 100.

According to the air conditioning device remote control apparatus 10 according to Embodiment 1, in the case of receiving the wireless route information 100 from another remote control apparatus 10, since one's own ID is saved appended to the last ID among the IDs included in the wireless route information 100, a route of the remote control apparatus 10 that have received the setting change operation signal can be constructed.

Also, the main control unit 14 of the air conditioning device remote control apparatus 10 according to Embodiment 1 performs, via the second communication control unit 12, detection of another remote control apparatus 10 emitting radio waves, and in the case in which the second communication control unit 12 does not detect another remote control apparatus 10 emitting radio waves, the main control unit 14 references the wireless route information 100 saved in the wireless route management unit 13 and transmits, via the second communication control unit 12, the wireless route information 100 to the remote control apparatus 10 with the ID higher in rank than its own ID by one ID in the array of IDs of the wireless route information.

Also, the air conditioning device remote control apparatus 10 according to Embodiment 1 is provided with the display unit 16 that displays information, and in the case in which the second communication control unit 12 receives the wireless route information 100 from the remote control apparatus 10 with the ID lower in rank than its own ID by one ID in the array of IDs of the wireless route information, the main control unit 14 references the wireless route information 100, and in the case in which an ID higher in rank than its own ID by one ID in the array of IDs of the wireless route information exists, the main control unit 14 transmits, via the second communication control unit 12, the wireless route information 100 received from the remote control apparatus 10 with the ID lower in rank than its own ID by one ID in the array of IDs of the wireless route information to the remote control apparatus 10 with the ID higher in rank than its own ID by one ID in the array of IDs of the wireless route information. In the case in which an ID higher in rank than its own ID by one ID in the array of IDs of the wireless route information does not exist, the main control unit 14 causes the display unit 16 to display the wireless route information 100 received from the remote control apparatus 10 with the ID lower in rank than its own ID by one ID in the array of IDs of the wireless route information.

According to the air conditioning device remote control apparatus 10 according to Embodiment 1, all air conditioning devices whose settings have been changed on all routes are displayed on the display unit 16 of the remote control apparatus 10 selected by the user. For this reason, the user is able to know all of the air conditioning devices whose settings have been changed from the selected remote control apparatus 10.

Also, in the case in which the second communication control unit 12 detects another remote control apparatus 10 emitting radio waves, the main control unit 14 of the air conditioning device remote control apparatus 10 according to Embodiment 1 saves the radio wave strength via the wireless route management unit 13.

According to the air conditioning device remote control apparatus 10 according to Embodiment 1, since the radio wave strength is saved in the case of detecting another remote control apparatus 10 emitting radio waves, mapping of the radio wave strength centered on the remote control apparatus 10 that transmitted the operation signal from the external wireless communication device 20 becomes possible.

By using this mapping, a remote control apparatus 10 not reached by the radio waves or a remote control apparatus 10 with weak radio waves can be grasped. For this reason, for example, a relay device can be provided between the remote control apparatus 10 of the transmission source and the remote control apparatus 10 of the transmission destination not reached by the radio waves, such that the radio waves reach the destination, or an amplifier can be provided in a remote control apparatus 10 with weak radio waves, such that the radio waves are strengthened.

Also, in the case in which the second communication control unit 12 detects other remote control apparatus 10 emitting radio waves, the main control unit 14 of the air conditioning device remote control apparatus 10 according to Embodiment 1 transmits, via the second communication control unit 12, the operation signal only to the another remote control apparatus 10 emitting radio waves of a strength equal to or greater than the reference value.

According to the air conditioning device remote control apparatus 10 according to Embodiment 1, since the operation signal is transmitted only to the another remote control apparatus 10 emitting radio waves of a strength equal to or greater than the reference value, when performing a setting change on multiple air conditioning devices with a single operation from the external wireless communication device 20, the setting change operation taking a long time can be avoided.

Also, the main control unit 14 of the air conditioning device remote control apparatus 10 according to Embodiment 1 causes information related to the radio wave strength of the another remote control apparatus 10 detected by itself to be included in the wireless route information 100 received from the remote control apparatus 10 with the ID lower in rank than its own ID by one ID in the array of IDs of the wireless route information. Also, the main control unit 14 forms an optimal route on the basis of the wireless route information 100 received from the remote control apparatus 10 with the ID lower in rank than its own ID by one ID in the array of IDs of the wireless route information and the information related to the radio wave strength of other remote control apparatus 10 detected by itself, and in the case in which multiple transmission routes exist for the remote control apparatus 10 with an ID lower in rank than its own ID by one ID in the array of IDs of the wireless route information, the main control unit 14 forms the optimal route by selecting the transmission route having the highest radio wave strength.

According to the air conditioning device remote control apparatus 10 according to Embodiment 1, by forming an optimal route, it is possible to transmit the operation signal in the shortest time to the air conditioning devices lower than oneself.

Note that in Embodiment 1, the destination to which to transmit the operation signal is limited to other remote control apparatus 10 emitting radio waves of strength equal to or greater than the reference value, but this is because if the strength of the radio waves is weak, the communication speed will become slower and take a long time. Accordingly, in cases where the time does not have to be considered, the destination to which to transmit the operation signal may be taken to be all other remote control apparatus 10 emitting radio waves.

Also, in Embodiment 1, the user selects a desired air conditioning device on which to perform the setting change and transmits the operation signal of the air conditioning device setting change to the associated remote control apparatus 10, but the configuration is not limited thereto, and the operation signal of the air conditioning device setting change may also be transmitted to the remote control apparatus 10 emitting the strongest radio waves from among the radio wave strengths detected by the external wireless communication device 20.

Embodiment 2

Hereinafter, Embodiment 2 of the present invention will be described, but description will be omitted for portions that overlap with Embodiment 1, and portions associated with the same portions in Embodiment 1 will be denoted with the same signs.

Figure 8:
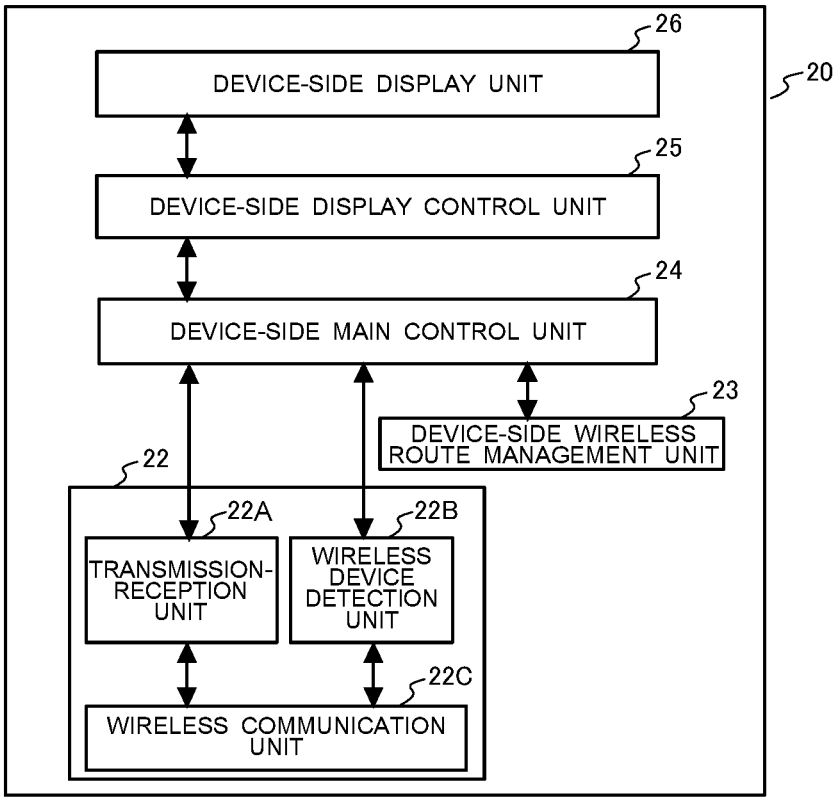
FIG. 8 is a diagram illustrating function blocks of a wireless communication device of an air conditioning system according to Embodiment 2 of the present invention.

FIG. 8 is a diagram illustrating function blocks of the wireless communication device 20 of an air conditioning system according to Embodiment 2 of the present invention.

The air conditioning system according to Embodiment 2 includes the air conditioning device remote control apparatus 10 described in Embodiment 1, and a wireless communication device 20 having a relay mode. As illustrated in FIG. 8, the wireless communication device 20 is provided with a device-side communication control unit 22, a device-side wireless route management unit 23, a device-side main control unit 24, a device-side display control unit 25, a device-side display unit 26, and a device-side operation unit (not illustrated). Also, the device-side communication control unit 22 is provided with a transmission-reception unit 22A, a wireless device detection unit 22B, and a wireless communication unit 22C.

The device-side communication control unit 22 performs wireless communication with the remote control apparatus 10 by technology such as Bluetooth (registered trademark), for example. The transmission-reception unit 22A transmits signals such as the operation signal to the remote control apparatus 10 through the wireless communication unit 22C.

Also, the transmission-reception unit 22A receives an operation signal from the remote control apparatus 10 through the wireless communication unit 22C, and receives the wireless route information 100 from the remote control apparatus 10 through the wireless communication unit 22C.

The wireless device detection unit 22B uses the wireless communication unit 22C to detect the remote control apparatus 10. Note that the remote control apparatus 10 emit radio waves, and the wireless device detection unit 22B detects the remote control apparatus 10 by having the wireless communication unit 22C detect the radio waves.

Note that the device-side communication control unit 22 corresponds to the "device-side wireless communication unit" of the present invention.

The device-side wireless route management unit 23 saves information such as the IDs of other detected remote control apparatus 10, the radio wave strengths of the another detected remote control apparatus 10, and information regarding its own allow setting/deny setting. Also, the device-side wireless route management unit 23 saves a program for executing the relay mode.

Herein, the wireless communication device 20 having the relay mode has an ID unique to every single device, and each wireless communication device 20 is specifiable from the ID.

The device-side display control unit 25 controls the device-side display unit 26. The device-side display unit 26 includes a liquid crystal panel, for example, and displays various information. Also, the device-side operation unit (not illustrated) includes buttons, for example, and accepts an operation related to a setting change in the associated air conditioning device performed by the user.

The device-side main control unit 24 controls the device-side communication control unit 22, the device-side wireless route management unit 23, and the device-side display control unit 25. Note that the device-side main control unit 24 may be configured by hardware such as a circuit device that realizes the functions of the device-side main control unit 24, and may also be configured by a computational device such as a CPU or a microprocessor and software that stipulates the operations of the computational device.

Note that since the function blocks of the remote control apparatus 10 are the same as those illustrated in FIG. 1, a description is omitted.

In Embodiment 2, the main control unit 14 of the remote control apparatus 10 performs, via the second communication control unit 12, detection of another remote control apparatus 10 emitting radio waves. Additionally, in the case in which the second communication control unit 12 does not detect another remote control apparatus 10 emitting radio waves, the main control unit 14 performs, via the second communication control unit 12, detection of the wireless communication device 20 in relay mode emitting radio waves. Additionally, in the case in which the second communication control unit 12 detects the wireless communication device 20 in relay mode emitting radio waves, the main control unit 14 transmits, via the second communication control unit 12, the operation signal to the wireless communication device 20 in relay mode emitting radio waves.

On the other hand, in the case in which the device-side communication control unit 22 receives the operation signal from the remote control apparatus 10 while in relay mode, the device-side main control unit 24 of the wireless communication device 20 performs, via the device-side communication control unit 22, detection of the remote control apparatus 10 emitting radio waves. Additionally, in the case in which the device-side communication control unit 22 detects the remote control apparatus 10 emitting radio waves, the device-side main control unit 24 transmits, via the device-side communication control unit 22, the operation signal to the remote control apparatus 10 emitting radio waves.

As above, because the wireless communication device 20 in relay mode serves as a relay device that relays the signals of the remote control apparatus 10, the air conditioning system according to Embodiment 2 is able to deliver radio waves through the wireless communication device 20 even to areas where direct radio waves from the remote control apparatus 10 do not reach.

Figure 9:
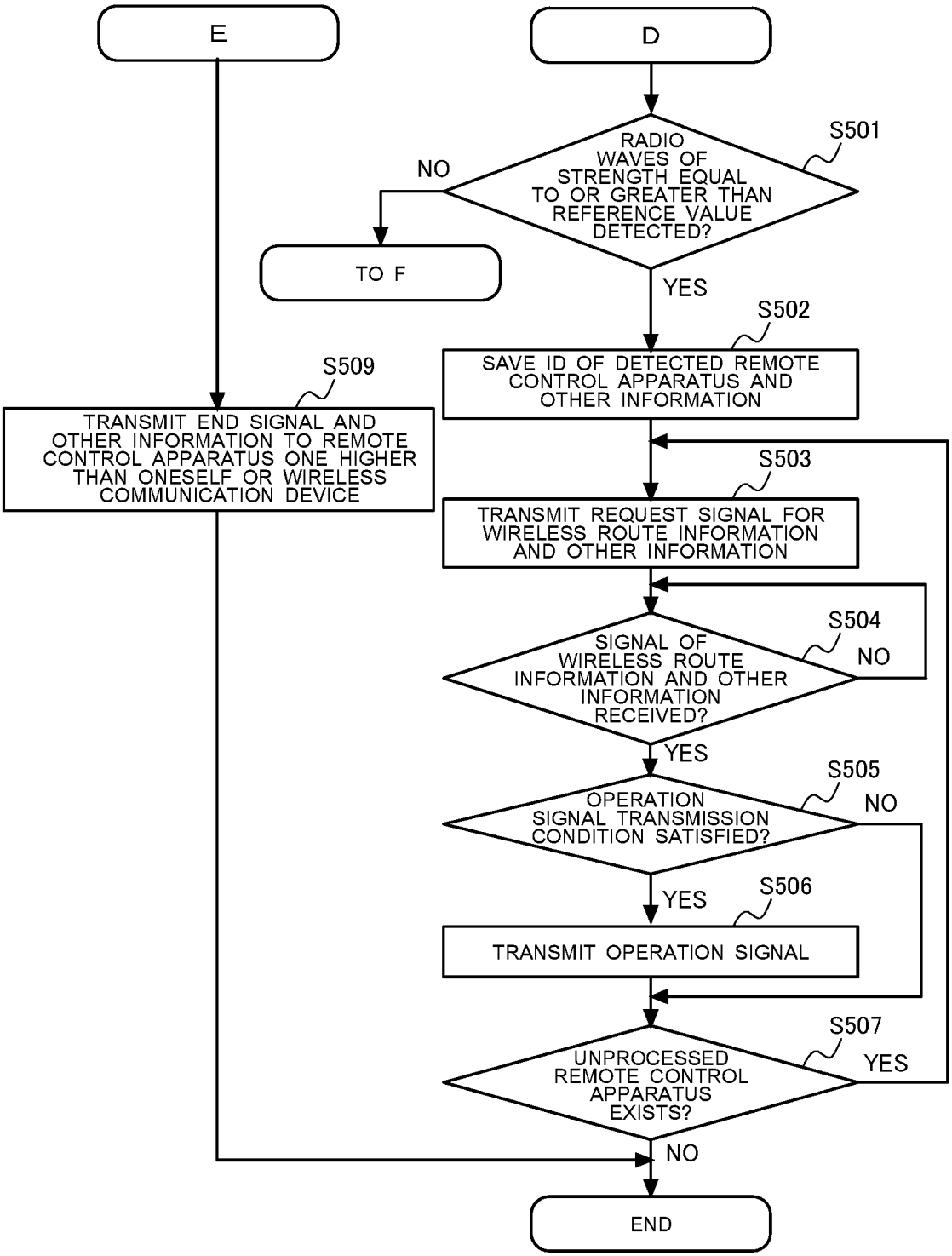
FIG. 9 is a diagram illustrating a first control flow of a master remote control apparatus of the air conditioning system according to Embodiment 2 of the present invention.
Figure 10:
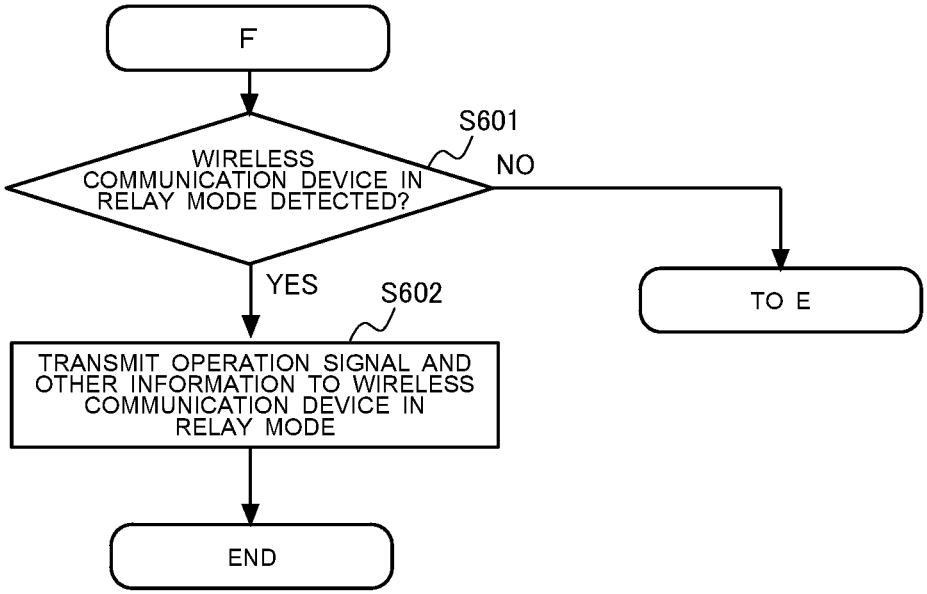
FIG. 10 is a diagram illustrating a second control flow of a master remote control apparatus of the air conditioning system according to Embodiment 2 of the present invention.
Figure 11:
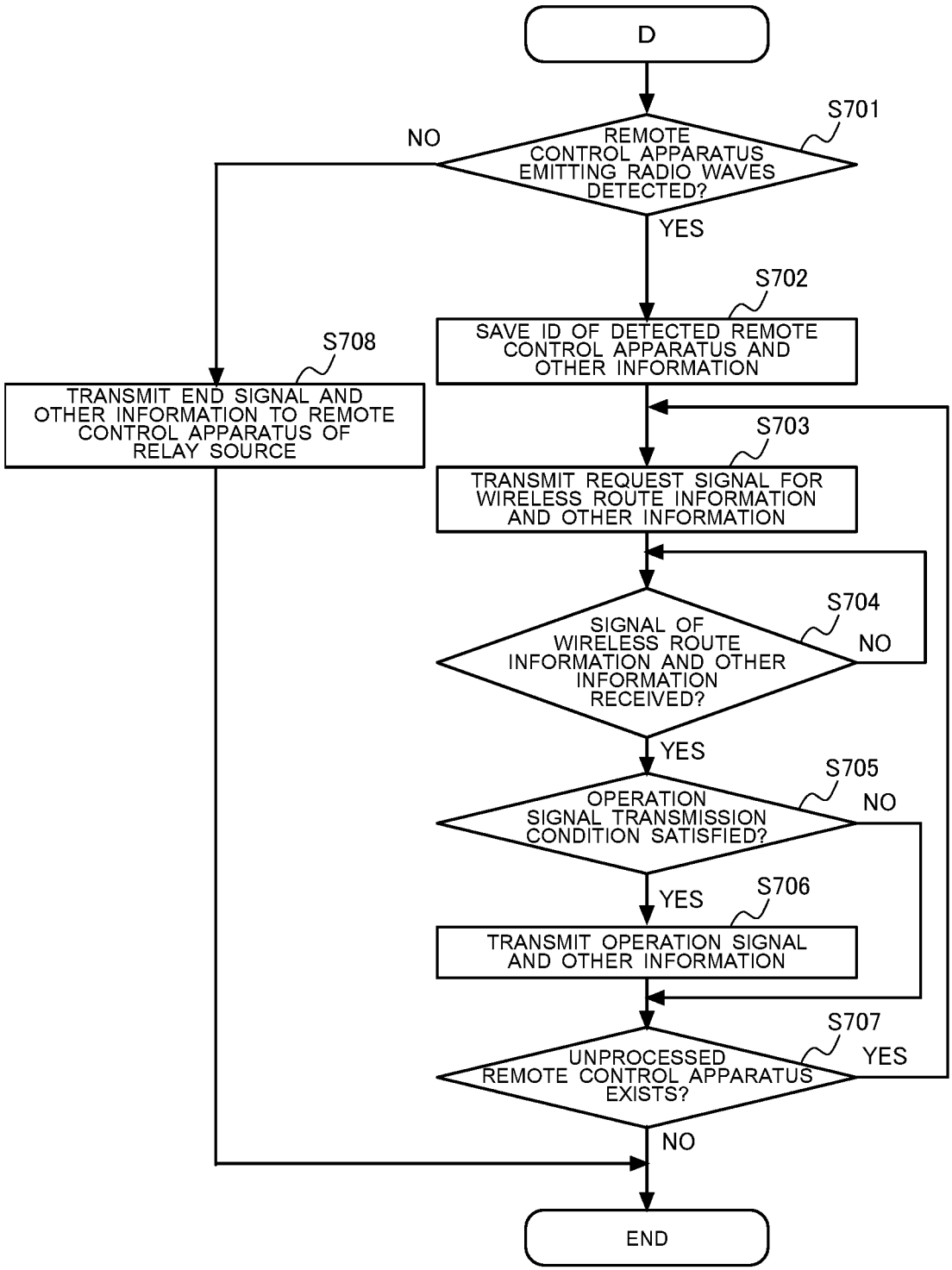
FIG. 11 is a diagram illustrating a control flow of a wireless communication device in a relay mode of the air conditioning system according to Embodiment 2 of the present invention.

FIG. 9 is a diagram illustrating a first control flow of a master remote control apparatus 10 of the air conditioning system according to Embodiment 2 of the present invention, FIG. 10 is a diagram illustrating a second control flow of a master remote control apparatus 10 of the air conditioning system according to Embodiment 2 of the present invention, and FIG. 11 is a diagram illustrating a control flow of the wireless communication device 20 in relay mode of the air conditioning system according to Embodiment 2 of the present invention.

The following uses FIGS. 3 to 6 and FIGS. 9 to 11 to describe mainly the portions that differ from Embodiment 1 regarding the control flows of the remote control apparatus 10 and the wireless communication device 20 of the air conditioning system when changing the settings of air conditioning devices from the wireless communication device 20 in the "batch setting mode".

Note that since the steps described in FIGS. 3 to 6 are similar to Embodiment 1, a description is omitted. Also, in Embodiment 2, assume that "other remote control apparatus" stated in steps S102 and S103 of FIG. 3 instead reads "other remote control apparatus or wireless communication device", that "master remote control apparatus" stated in step S302 of FIG. 5 instead reads "master remote control apparatus or wireless communication device", and that "remote control apparatus higher than oneself" stated in step S402 of FIG. 6 instead reads "remote control apparatus higher than oneself or wireless communication device".

First, the master remote control apparatus 10 will be described. In step S501, on the basis of a notification from the second communication control unit 12, the main control unit 14 determines whether or not a remote control apparatus 10 emitting radio waves of a strength equal to or greater than the reference value exists.

In the case of determining that a remote control apparatus 10 emitting radio waves of a strength equal to or greater than the reference value exists (YES in step S501), the main control unit 14 proceeds to step S502. Note that since the process from step S502 to S507 is similar to Embodiment 1, a description is omitted. On the other hand, in the case of determining that a remote control apparatus 10 emitting radio waves of a strength equal to or greater than the reference value does not exist (NO in step S501), the main control unit 14 proceeds to step S601.

In step S601, on the basis of a notification from the second communication control unit 12, the main control unit 14 determines whether or not a wireless communication device 20 in relay mode emitting radio waves exists. In the case of determining that a wireless communication device 20 in relay mode emitting radio waves does not exist (NO in step S601), the main control unit 14 proceeds to step S509.

In step S509, the main control unit 14 references, via the wireless route management unit 13, the saved wireless route information 100. Additionally, the second communication control unit 12, according to an instruction from the main control unit 14, transmits the end signal and the wireless route information 100 to the remote control apparatus 10 with the ID higher in rank than its own ID by one ID in the array of IDs of the wireless route information or the wireless communication device 20 (step S509).

On the other hand, in step S601, in the case of determining that a wireless communication device 20 in relay mode emitting radio waves exists (YES in step S601), the main control unit 14 transmits, via the second communication control unit 12, the operation signal to the wireless communication device 20 in relay mode emitting radio waves (step S602), and ends the process.

Next, the wireless communication device 20 in relay mode will be described. In step S701, on the basis of a notification from the device-side communication control unit 22, the device-side main control unit 24 determines whether or not a remote control apparatus 10 emitting radio waves of a strength equal to or greater than the reference value (a remote control apparatus 10 other than the remote control apparatus 10 from which the operation signal was received) exists (step S701).

In the case of determining that a remote control apparatus 10 emitting radio waves of a strength equal to or greater than the reference value exists (YES in step S701), the device-side main control unit 24 proceeds to step S702.

In step S702, the device-side main control unit 24 saves, via the device-side wireless route management unit 23, the ID of the detected remote control apparatus 10 and the radio wave strength of the detected remote control apparatus 10.

Also, the device-side communication control unit 22, according to an instruction from the device-side main control unit 24, transmits the request signal for automatic change information and the wireless route information 100 to the remote control apparatus 10 emitting radio waves of a strength equal to or greater than the reference value (step S703). Note that the automatic change information includes information related to the allow setting/deny setting.

At this point, in the case in which the device-side main control unit 24 detects, via the device-side communication control unit 22, multiple remote control apparatuses 10 emitting radio waves of a strength equal to or greater than the reference value, the device-side main control unit 24 instructs the device-side communication control unit 22 to transmit the request signal for the automatic change information and the wireless route information 100 sequentially starting from the remote control apparatus 10 emitting the strongest radio waves among those detected.

In the case in which the device-side communication control unit 22 receives the automatic change information and the wireless route information 100 from the slave remote control apparatus 10 (YES in step S704), the device-side communication control unit 22 notifies the device-side main control unit 24, and from the received information, the device-side main control unit 24 determines whether or not the operation signal transmission condition is satisfied (step S705).

At this point, the operation signal transmission condition is that the allow setting is set in the remote control apparatus 10 of the transmission destination, and that the ID of the remote control apparatus 10 of the transmission destination is not included in the wireless route information 100.

Note that the case in which the ID of the remote control apparatus 10 of the transmission destination is included in the received wireless route information 100 means that the remote control apparatus 10 of the transmission destination has already received the operation signal of an air conditioning device setting change from another remote control apparatus 10. Accordingly, in this case, by not transmitting the operation signal of an air conditioning device setting change and the wireless route information 100 to the remote control apparatus 10 of the transmission destination, duplication of the setting change in the air conditioning device can be avoided.

In step S705, in the case in which the device-side main control unit 24 determines that the operation signal transmission condition is satisfied (YES in step S705), the device-side communication control unit 22, according to an instruction from the device-side main control unit 24, transmits the operation signal of an air conditioning device setting change and the wireless route information 100 to the slave remote control apparatus 10 (step S706), and proceeds to step S707. On the other hand, in the case of determining that the operation signal transmission condition is not satisfied (NO in step S705), the device-side main control unit 24 does not execute step S706 and proceeds to step S707.

In step S707, the device-side main control unit 24 determines whether or not an unprocessed remote control apparatus 10 exists among the detected remote control apparatus 10. In the case of determining that an unprocessed remote control apparatus 10 exists (YES in step S707), the device-side main control unit 24 returns to step S703 and repeats the process of steps S703 to S707. On the other hand, in the case of determining that an unprocessed remote control apparatus 10 does not exist, the device-side main control unit 24 ends the process.

On the other hand, in step S701, in the case of determining that a remote control apparatus 10 emitting radio waves of a strength equal to or greater than the reference value does not exist (NO in step S701), the device-side main control unit 24 proceeds to step S708.

In step S708, the device-side communication control unit 22, according to an instruction from the device-side main control unit 24, transmits the end signal and the wireless route information 100 to the remote control apparatus 10 of the relay source (step S708), and ends the process.

As above, the air conditioning system according to Embodiment 2 is provided with the air conditioning device remote control apparatus 10 and the wireless communication device 20 having the relay mode. The wireless communication device 20 is provided with the device-side communication control unit 22 that performs wireless communication with the remote control apparatus 10 and the device-side main control unit 24 that controls the device-side communication control unit 22. While in the relay mode, the device-side main control unit 24 receives the operation signal from the remote control apparatus 10, and transmits the received operation signal to another remote control apparatus 10.

Also, the main control unit 14 performs, via the second communication control unit 12, detection of another remote control apparatus 10 emitting radio waves, and in the case in which the second communication control unit 12 does not detect another remote control apparatus 10 emitting radio waves, the main control unit 14 performs, via the second communication control unit 12, detection of a wireless communication device 20 in relay mode emitting radio waves. In the case in which the second communication control unit 12 detects a wireless communication device 20 in relay mode emitting radio waves, the main control unit 14 transmits, via the second communication control unit 12, the operation signal to the wireless communication device 20 in relay mode emitting radio waves.

Also, in the case in which the device-side communication control unit 22 receives the operation signal from the remote control apparatus 10 while in relay mode, the device-side main control unit 24 performs, via the device-side communication control unit 22, detection of another remote control apparatus 10 emitting radio waves, and in the case in which the device-side communication control unit 22 detects another remote control apparatus 10 emitting radio waves, the device-side main control unit 24 transmits, via the device-side communication control unit 22, the operation signal to the another remote control apparatus 10 emitting radio waves.

According to the air conditioning system according to Embodiment 2, because the wireless communication device 20 in relay mode serves as a relay device that relays the signals of the remote control apparatus 10, it is possible to deliver radio waves through the wireless communication device 20 even to areas where direct radio waves from the remote control apparatus 10 do not reach.

For this reason, by having a person carrying the wireless communication device 20, such as a hotel staff member for example, walk around inside the building, the wireless communication device 20 becomes a walking relay device capable of delivering radio waves even to areas not reached in the past, and the operation signal can be transmitted over a wider range.

REFERENCE SIGNS LIST

10 remote control apparatus 11 first communication control unit 11A first transmission-reception unit 11B first wireless communication unit 12 second communication control unit 12A second transmission-reception unit 12B wireless device detection unit 12C second wireless communication unit 13 wireless route management unit 14 main control unit 15 display control unit display unit 20 wireless communication device 22 device-side communication control unit 22A transmission-reception unit 22B wireless device detection unit 22C wireless communication unit 23 device-side wireless route management unit 24 device-side main control unit 25 device-side display control unit 26 device-side display unit 100 wireless route information

The invention claimed is:

1. An air conditioning device remote control apparatus comprising:

a transmission unit that transmits an operation signal to an associated air conditioning device;

a wireless communication unit that performs wireless communication with an external wireless communication device or another remote control apparatus; and a main control unit that controls the transmission unit and the wireless communication unit, wherein in a case in which the wireless communication unit receives an operation signal from the external wireless communication device or the another remote control apparatus, the main control unit transmits, via the transmission unit, the operation signal to the associated air conditioning device, and performs, via the wireless communication unit, detection of another remote control apparatus emitting radio waves, wherein in a case in which the wireless communication unit detects the another remote control apparatus emitting radio waves, the main control unit transmits, via the wireless communication unit, the operation signal to the another remote control apparatus emitting radio waves, and wherein in a case in which the wireless communication unit detects another remote control apparatus emitting radio waves, the main control unit transmits, via the wireless communication unit, the operation signal only to the another remote control apparatus emitting radio waves of a strength equal to or greater than a reference value.

2. An air conditioning device remote control apparatus comprising:

a transmission unit that transmits an operation signal to an associated air conditioning device;

a wireless communication unit that performs wireless communication with an external wireless communication device or another remote control apparatus; and a main control unit that controls the transmission unit and the wireless communication unit, wherein in a case in which the wireless communication unit receives an operation signal from the external wireless communication device or the another remote control apparatus, the main control unit transmits, via the transmission unit, the operation signal to the associated air conditioning device, and performs, via the wireless communication unit, detection of another remote control apparatus emitting radio waves, wherein in a case in which the wireless communication unit detects the another remote control apparatus emitting radio waves, the main control unit transmits, via the wireless communication unit, the operation signal to the another remote control apparatus emitting radio waves, wherein the air conditioning device remote control apparatus further comprises a wireless route management unit that saves wireless route information including an ID that identifies a remote control apparatus, wherein the wireless route information includes the IDs of the remote control apparatus that have received the operation signal thus far, in an order in which the operation signal was received, and wherein in a case in which the wireless communication unit receives the wireless route information from the another remote control apparatus, the main control unit saves, via the wireless route management unit, its own ID appended to a last ID among the IDs included in the wireless route information.

3. The air conditioning device remote control apparatus of claim 2, wherein the main control unit performs, via the wireless communication unit, the detection of another remote control apparatus emitting radio waves, and in a case in which the wireless communication unit does not detect another remote control apparatus emitting radio waves, the main control unit references the wireless route information saved in the wireless route management unit and transmits, via the wireless communication unit, the wireless route information to the remote control apparatus with the ID higher in rank than its own ID by one ID in the array of IDs of the wireless route information.

4. The air conditioning device remote control apparatus of claim 3, further comprising a display unit that displays information, wherein in a case in which the wireless communication unit receives the wireless route information from the remote control apparatus with the ID lower in rank than its own ID by one ID in the array of IDs of the wireless route information, the main control unit references the wireless route information, and in a case in which an ID higher in rank than its own ID by one ID in the array of IDs of the wireless route information exists, the main control unit transmits, via the wireless communication unit, the wireless route information received from the remote control apparatus with the ID lower in rank than its own ID by one ID in the array of IDs of the wireless route information to the remote control apparatus with the ID higher in rank than its own ID by one ID in the array of IDs of the wireless route information, whereas in a case in which an ID higher in rank than its own ID by one ID in the array of IDs of the wireless route information does not exist, the main control unit causes the display unit to display the wireless route information received from the remote control apparatus with the ID lower in rank than its own ID by one ID in the array of IDs of the wireless route information.

5. The air conditioning device remote control apparatus of claim 2, wherein in a case in which the wireless communication unit detects the another remote control apparatus emitting radio waves, the main control unit saves a radio wave strength via the wireless route management unit.

6. The air conditioning device remote control apparatus of claim 5, further comprising a display unit that displays information, wherein in a case in which the wireless communication unit receives the wireless route information from the remote control apparatus with the ID lower in rank than its own ID by one ID in the array of IDs of the wireless route information, the main control unit references the wireless route information, and in a case in which an ID higher in rank than its own ID by one ID in the array of IDs of the wireless route information exists, the main control unit transmits, via the wireless communication unit, the wireless route information received from the remote control apparatus with the ID lower in rank than its own ID by one ID in the array of IDs of the wireless route information to the remote control apparatus with the ID higher in rank than its own ID by one ID in the array of IDs of the wireless route information, whereas in a case in which an ID higher in rank than its own ID by one ID in the array of IDs of the wireless route information does not exist, the main control unit causes the display unit to display the wireless route information received from the remote control apparatus with the ID lower in rank than its own ID by one ID in the array of IDs of the wireless route information, and wherein the main control unit causes information related to the radio wave strength of the another remote control apparatus detected by itself to be included in the wireless route information received from the remote control apparatus with the ID lower in rank than its own ID by one ID in the array of IDs of the wireless route information.

7. The air conditioning device remote control apparatus of claim 6, wherein the main control unit forms an optimal route on a basis of the wireless route information received from the remote control apparatus with the ID lower in rank than its own ID by one ID in the array of IDs of the wireless route information and the information related to the radio wave strength of the another remote control apparatus detected by itself, and in a case in which a plurality of transmission routes exists for the remote control apparatus with the ID lower in rank than its own ID by one ID in the array of IDs of the wireless route information, the main control unit forms the optimal route by selecting the transmission route with the highest radio wave strength.

8. An air conditioning system comprising:

the air conditioning device remote control apparatus of claim 1; and the wireless communication device having a relay mode, wherein:

the wireless communication device includes a device-side wireless communication unit that performs wireless communication with the remote control apparatus, and a device-side main control unit that controls the device-side wireless communication unit, and while in the relay mode, the device-side main control unit receives the operation signal from the remote control apparatus and transmits the received operation signal to another remote control apparatus.

9. The air conditioning system of claim 8, wherein the main control unit performs, via the wireless communication unit, the detection of another remote control apparatus emitting radio waves, and in a case in which the wireless communication unit does not detect another remote control apparatus emitting radio waves, the main control unit performs, via the wireless communication unit, detection of the wireless communication device in the relay mode emitting radio waves, and in a case in which the wireless communication unit detects the wireless communication device in the relay mode emitting radio waves, the main control unit transmits, via the wireless communication unit, the operation signal to the wireless communication device in the relay mode emitting radio waves.

10. The air conditioning system of claim 8, wherein:

in a case in which the device-side wireless communication unit receives the operation signal from the remote control apparatus while in the relay mode, the device-side main control unit performs, via the wireless communication unit, detection of another remote control apparatus emitting radio waves, and in a case in which the device-side wireless communication unit detects the another remote control apparatus emitting radio waves, the device-side main control unit transmits, via the device-side wireless communication unit, the operation signal to the another remote control apparatus emitting radio waves.

11. The air conditioning device remote control apparatus of claim 2, wherein the radio waves are for use in wireless communication.

12. The air conditioning device remote control apparatus of claim 8, wherein the radio waves are for use in wireless communication.

13. An air conditioning system comprising:

the air conditioning device remote control apparatus of claim 2; and the wireless communication device having a relay mode, wherein:

the wireless communication device includes a device-side wireless communication unit that performs wireless communication with the remote control apparatus, and a device-side main control unit that controls the device-side wireless communication unit, and while in the relay mode, the device-side main control unit receives the operation signal from the remote control apparatus and transmits the received operation signal to another remote control apparatus.

14. The air conditioning system of claim 13, wherein:

the main control unit performs, via the wireless communication unit, the detection of another remote control apparatus emitting radio waves, in a case in which the wireless communication unit does not detect another remote control apparatus emitting radio waves, the main control unit performs, via the wireless communication unit, detection of the wireless communication device in the relay mode emitting radio waves, and in a case in which the wireless communication unit detects the wireless communication device in the relay mode emitting radio waves, the main control unit transmits, via the wireless communication unit, the operation signal to the wireless communication device in the relay mode emitting radio waves.

15. The air conditioning system of claim 13, wherein:

in a case in which the device-side wireless communication unit receives the operation signal from the remote control apparatus while in the relay mode, the device-side main control unit performs, via the wireless communication unit, detection of another remote control apparatus emitting radio waves, and in a case in which the device-side wireless communication unit detects the another remote control apparatus emitting radio waves, the device-side main control unit transmits, via the device-side wireless communication unit, the operation signal to the another remote control apparatus emitting radio waves.

16. The air conditioning device remote control apparatus of claim 1, wherein the radio waves are for use in wireless communication.

17. The air conditioning device remote control apparatus of claim 13, wherein the radio waves are for use in wireless communication.

* * * * *